US007637476B2

(12) United States Patent
Mugica et al.

(10) Patent No.: US 7,637,476 B2
(45) Date of Patent: Dec. 29, 2009

(54) CONTROL SYSTEM FOR A GAS COOKING DEVICE

(75) Inventors: Jose Ignacio Mugica, Bergara (ES); Gonzalo Fernandez, Elorrio (ES); Iñaki Ayastuy, Bergara (ES)

(73) Assignee: Coprecitec, S.L., Aretxabaleta (Guipuzcoa) (ES)

( * ) Notice: Subject to any disclaimer, the term of this patent is extended or adjusted under 35 U.S.C. 154(b) by 456 days.

(21) Appl. No.: 11/662,868

(22) PCT Filed: Dec. 21, 2005

(86) PCT No.: PCT/EP2005/013757

§ 371 (c)(1),
(2), (4) Date: Mar. 14, 2007

(87) PCT Pub. No.: WO2006/069686

PCT Pub. Date: Jul. 6, 2006

(65) Prior Publication Data

US 2009/0194720 A1 Aug. 6, 2009

(30) Foreign Application Priority Data

Dec. 29, 2004 (EP) ..... 04380281

(51) Int. Cl.
*F16K 31/02* (2006.01)

(52) U.S. Cl. ..... 251/129.04; 431/66

(58) Field of Classification Search ..... 251/129.04; 431/6, 66, 72, 75

See application file for complete search history.

(56) References Cited

U.S. PATENT DOCUMENTS 2,301,446 A * 11/1942 Ott ..... 431/66
2,849,663 A * 8/1958 Thornbery et al. ..... 431/57
3,171,469 A * 3/1965 Mudd ..... 431/71
3,954,383 A * 5/1976 Bryant ..... 251/129.04
5,085,574 A * 2/1992 Wilson ..... 431/6

(Continued)

FOREIGN PATENT DOCUMENTS

EP 0635680 A1 1/1995

(Continued)

OTHER PUBLICATIONS

European Patent Office, International Search Report for International Application No. PCT/EP2005/013757, Oct. 2, 2006, Netherlands.

*Primary Examiner*—John Bastianelli
(74) *Attorney, Agent, or Firm*—Tim L. Kitchen; Peter B. Scull; Berenbaum Weinshienk PC

(57) ABSTRACT

"Control system for a gas cooking device or any other gas device comprising at least one gas burner (1) and, for each gas burner (1), an electromagnetic valve (2) to open or cut off the gas flow to the gas burner (1), said electromagnetic valve (2) comprising magnetic means (10, 11, 12) to keep the gas flow open, and an actuator (3) that is operated manually so that it acts on the magnetic means (10, 11, 12) of the electromagnetic valve (2), thereby opening the gas flow. The control system (20) generates a current signal (I) that circulates through the magnetic means (10, 11, 12) of the electromagnetic valve (2) and detects when the actuator (3) is operated in accordance with the change in magnetic reluctance of said magnetic means (10, 11, 12)."

9 Claims, 4 Drawing Sheets

U.S. PATENT DOCUMENTS

| | | | | |
|---|---|---|---|---|
| 6,058,927 | A * | 5/2000 | Maritan et al. | 431/153 |
| 6,279,870 | B1 * | 8/2001 | Welz et al. | 251/129.04 |
| 6,322,352 | B1 | 11/2001 | Zink | |
| 2005/0170302 | A1 * | 8/2005 | Ayastuy et al. | 431/75 |

FOREIGN PATENT DOCUMENTS

| | | | |
|---|---|---|---|
| GB | 2249383 | A | 5/1992 |
| GB | 2267335 | A | 12/1993 |

* cited by examiner

CONTROL SYSTEM FOR A GAS COOKING DEVICE

TECHNICAL FIELD

The present invention relates to control systems, in particular for gas cooking devices, but applicable also in other types of gas devices that comprise at least one gas burner and, for each gas burner, an electromagnetic valve that can be operated by the user by means of an actuator to open it.

PRIOR ART

In known arrangements some gas cooking devices have at least one gas burner and, for each gas burner, an electromagnetic valve to open or cut off the gas flow to the gas burner, with said electromagnetic valve comprising magnetic means to keep the gas flow open. EP 0635680 A1 discloses a gas device with an electromagnetic valve with these characteristics.

In order to light a burner the user manually operates an actuator. In gas cooking devices that use electromagnetic valves such as those set forth, when the actuator is operated said actuator pushes the magnetic means of the electromagnetic valve, thereby opening the gas flow.

Known control systems for this type of gas cooking device comprise, among other means, means for detecting when the actuator is operated. Usually, said means comprise a switch that is activated when the user operates the actuator, with the operating of the actuator thus being detected through said switch. U.S. Pat. No. 6,322,352 discloses a control system for gas cooking devices in which the operating of the actuator is detected by a switch.

DISCLOSURE OF THE INVENTION

The object of the invention is to provide a control system for a gas cooking device that detects the operating of the actuator in an alternative way to that used in the prior art.

The inventive control system is applied in gas cooking devices or other types of gas devices of the type that comprise, for each gas burner, an electromagnetic valve to open or cut off the gas flow to the gas burner, with said electromagnetic valve comprising magnetic means to keep the gas flow open, and an actuator that is operated manually so that it acts on the magnetic means of the electromagnetic valve, thereby opening the gas flow.

The inventive control system generates a current signal that circulates through the magnetic means. When the actuator is operated, a change in magnetic reluctance of the magnetic means occurs, with said control system detecting the operating of the actuator in accordance with the change in magnetic reluctance.

In the inventive control system it is not necessary to use switches to determine when the actuator corresponding to a burner is operated, and as a result the control system is simpler and more inexpensive.

These and other advantages and characteristics of the invention will be made evident in the light of the drawings and the detailed description thereof.

DETAILED DESCRIPTION OF THE INVENTION

Figure 1:
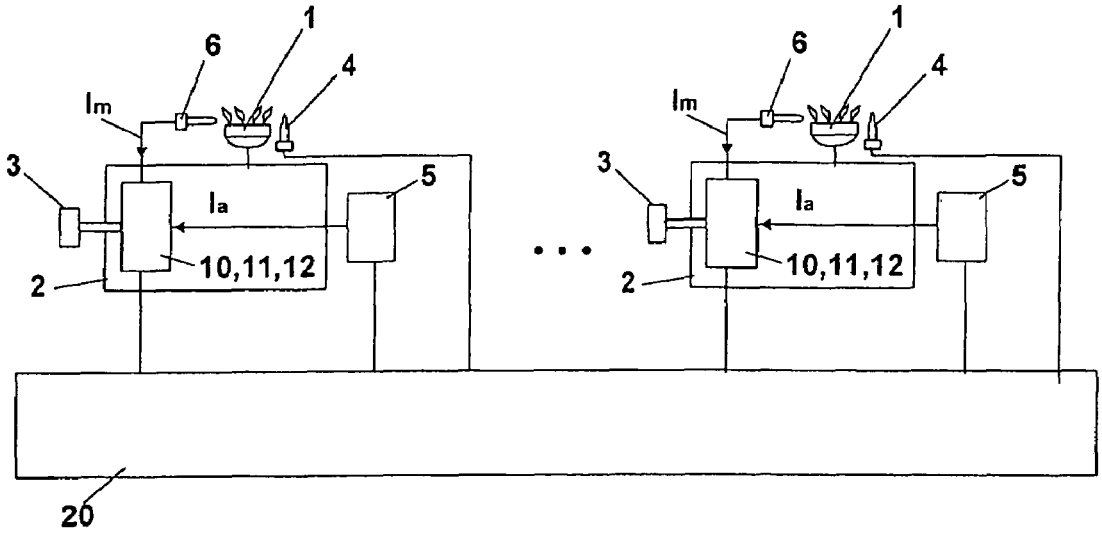
FIG. 1 shows a general diagram of a gas cooking device.

FIG. 1 shows an embodiment of a gas cooking device, more specifically a gas hob, with said gas cooking device comprising a number of gas burners 1 and, for each gas burner 1, an electromagnetic valve 2 to open and cut off the gas flow to the corresponding gas burner 1. Each electromagnetic valve 2 comprises magnetic means 10, 11 and 12 to keep the gas flow open. The user opens the gas flow to each gas burner 1 by manually operating an actuator 3. Said actuator 3 acts on the magnetic means 10, 11 and 12 of the corresponding electromagnetic valve 2.

Figure 6:
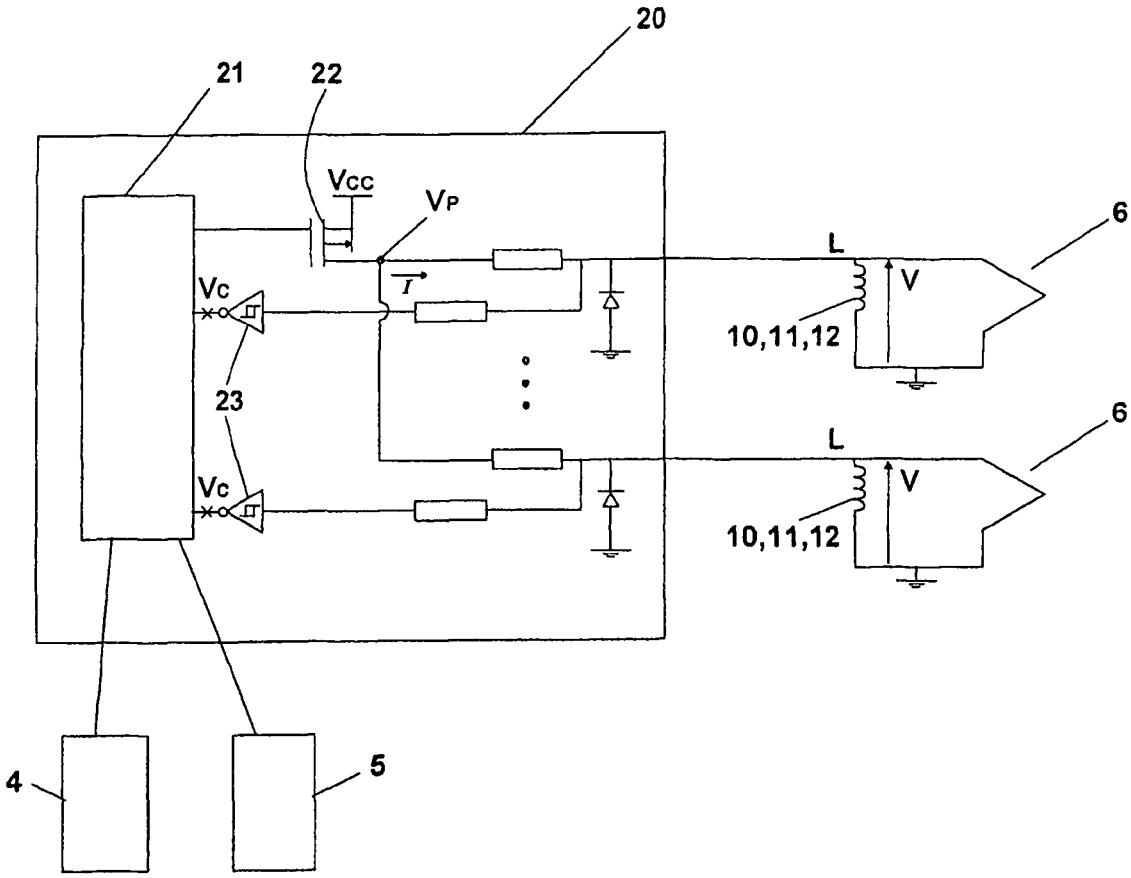
FIG. 6 shows an embodiment of the inventive control system.

The inventive control system 20, in order to detect when some of the actuators 3 are operated, generates a current signal I that circulates through the magnetic means 10, 11 and 12 of each of the electromagnetic valves 2 of the gas cooking device. Thus, the magnetic means 10, 11 and 12 have a specific inductance L, as shown in FIG. 6. When the actuator 3 is operated and the magnetic means 10, 11 and 12 are acted on, a change in the inductance of the magnetic means 10, 11 and 12 of the corresponding electromagnetic valve 2 occurs or, what is the same, a change in magnetic reluctance as both magnitudes are inversely proportional. The control system 20 detects the operating of the actuator 3 in accordance with said change in magnetic reluctance.

Figure 2:
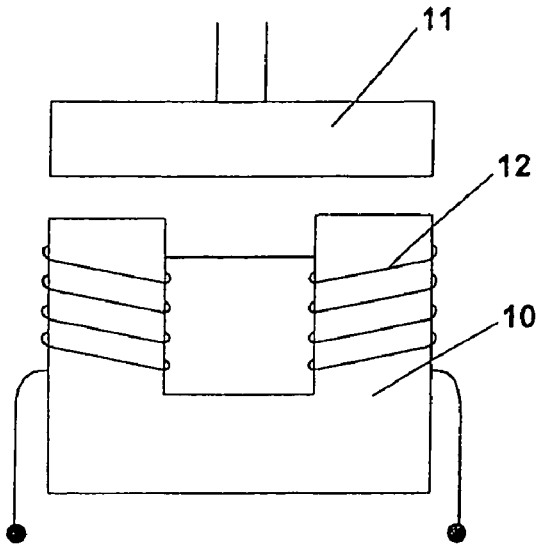
FIG. 2 shows the magnetic means of an electromagnetic valve in the situation in which there is no gas flow.
Figure 4:
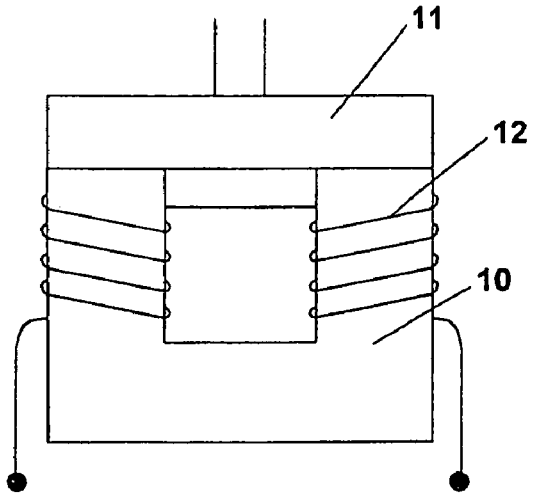
FIG. 4 shows the magnetic means of the electromagnetic valve in the situation in which there is a gas flow.

The magnetic means 10, 11 and 12 comprise a core 10, a plate 11 and a winding 12 wound on the core 10, as shown in FIGS. 2 and 4. The current signal I circulates through the winding 12 generating a magnetomotive force $\mathcal{F}$.

Figure 3:
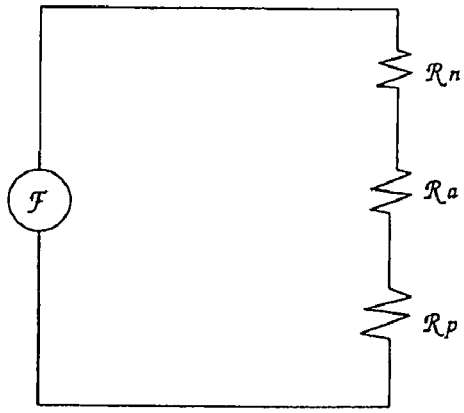
FIG. 3 shows the equivalent magnetic circuit of the magnetic means in the situation in FIG. 2.

FIG. 3 shows the equivalent magnetic circuit of the magnetic means 10, 11 and 12 when the current signal I circulates through said magnetic means 10, 11 and 12, with the magnetic means 10, 11 and 12 in the situation shown in FIG. 2, i.e. in the situation in which there is no gas flow. The magnetic reluctance of said magnetic means 10, 11 and 12 in said situation is determined by the following equation:

$$\mathcal{R}_{total}=\mathcal{R}_n+\mathcal{R}_a+\mathcal{R}_p$$

Where:

$\mathcal{R}_{total}$=Magnetic reluctance of the magnetic means 10, 11 and 12.

$\mathcal{R}_n$=Magnetic reluctance of the core 10.

$\mathcal{R}_p$=Magnetic reluctance of the plate 11.

$\mathcal{R}_a$=Magnetic reluctance of the air.

Figure 5:
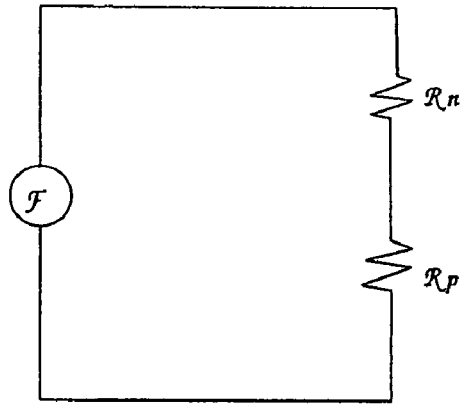
FIG. 5 shows the equivalent magnetic circuit of the magnetic means in the situation in FIG. 4.

When the actuator 3 is operated, the plate 11 comes into contact with the core 10, as shown in FIG. 4. In that situation, when the current signal I circulates through the magnetic means 10, 11 and 12, the equivalent magnetic circuit is that shown in FIG. 5 and the magnetic reluctance of said magnetic means 10, 11 and 12 is determined by the following equation:

$$\mathcal{R}_{total}=\mathcal{R}_n+\mathcal{R}_p$$

As the magnetic reluctance of the air is much greater than the magnetic reluctance of the plate 11 and the magnetic reluctance of the core 10, the resulting magnetic reluctance is much smaller. Thus, it is noted that when the actuator 3 is operated, there is a change in magnetic reluctance of the magnetic means 10, 11 and 12. The control system 20 detects said change in magnetic reluctance by checking the voltage V in the terminals of the magnetic means 10, 11 and 12.

The control system 20, shown schematically in FIG. 6, comprises a microcontroller 21. Said microcontroller 21 generates a pulses voltage signal that is applied to the gate of a MOSFET 22 transistor, generating at the outlet of the MOSFET 22 transistor a pulse signal Vp that generates the current signal I that crosses the magnetic means 10, 11 and 12. The control system 20 checks the voltage V in each of the pulses of said pulse signal Vp.

The control system 20 checks the voltage V in a sampling instant t from the beginning of each pulse, so that it is determined that the actuator 3 has been operated because, due to the change in magnetic reluctance caused by said operating, the checked voltage V moves, between consecutive pulses, from a smaller value than a reference voltage Vr to a larger value than said reference voltage Vr. To achieve this, said voltage V is applied to the gate of a Schmitt trigger 23, which compares said voltage V with the reference value, with said reference value being the reference voltage Vr. Thus, a control signal Vc is generated and is read by the microcontroller 21 in the sampling instants t.

Figure 7:
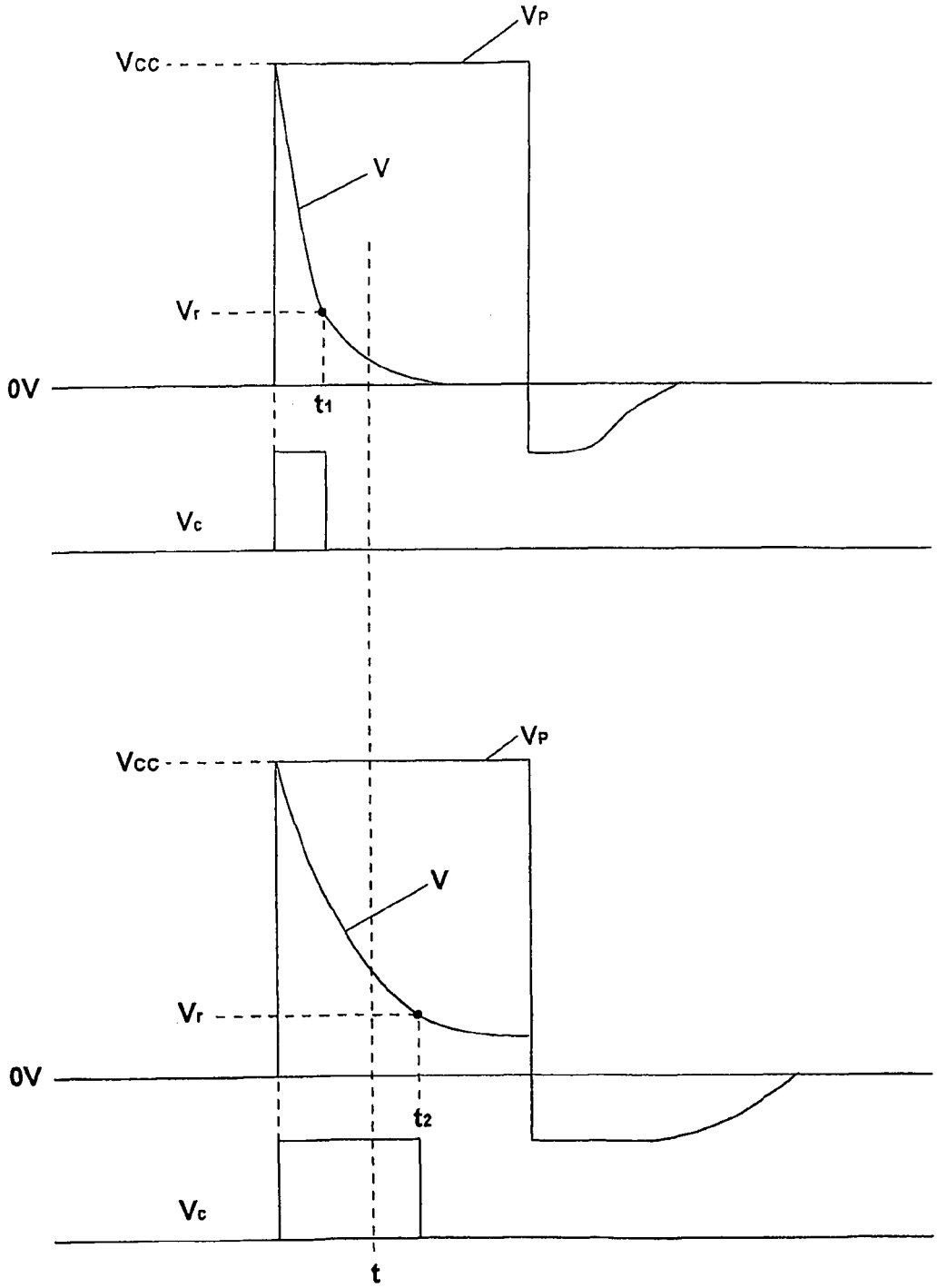
FIG. 7 shows the pulse signal generated by the control system, the voltage in the terminals of the magnetic means, and the resulting control signal.

The sampling instant t is in the interval ranging between a first instant t1 and a second instant t2, as shown in FIG. 7. The first instant t1 is the instant from the beginning of each pulse in which, with the magnetic means 10, 11 and 12 in the situation in FIG. 2 (gas flow cut off), the voltage V reaches the reference voltage Vr. The second instant t2 is the instant from the beginning of each pulse in which, with the magnetic means 10, 11 and 12 in the situation in FIG. 4 (gas flow open), the voltage V reaches the reference voltage Vr.

The pulse signal Vp has a frequency between 20 Hz and 1 kHz. In the preferred embodiment a pulse signal Vp of 50 Hz is used.

FIG. 7 shows the voltage V in the terminals on the magnetic means 10, 11 and 12 for the situation in FIG. 2 (top diagram) and for the situation in FIG. 4 (bottom diagram), in addition to the control signals Vc corresponding to each situation. For a supply voltage Vcc of the control system 20 of 5 volts, a reference voltage Vr of, for example, 1V can be chosen. For said reference voltage Vr, the first instant t1 is around 1.5 μs from the beginning of each of the pulses of pulse signal Vp, whereas the second instant t2 is around 3.5 μs from the beginning of each of the pulses of pulse signal Vp. Therefore, the sampling instant t is between approximately 1.5 μs and approximately 3.5 μs from the beginning of each of the pulses of said pulse signal Vp. As can be seen in FIG. 7, when the gas flow is cut off the control signal Vc in the sampling instant t has a value of 0. In contrast, when the gas flow is opened, the control signal Vc has a value of 1 in said sampling instant t. When the change in magnetic reluctance of the magnetic means 10, 11 and 12 is detected, the control system 20 acts on a spark generator 4 (see FIG. 1), with said spark generator 4 generating a series of sparks in order to light a flame in the corresponding gas burner 1.

Similarly, the control system 20 acts on assistance means 5 (see FIG. 1), thus making said assistance means 5 circulate a maintenance current Ia through the magnetic means 10, 11 and 12 of the corresponding electromagnetic valve 2 to keep the gas flow open.

The maintenance current Ia is generated for a sufficient interval of time to allow the gas flow to be kept open by the action of a thermocouple 6 disposed in the corresponding gas burner 1 (see FIG. 1). When the flame is lit, the thermocouple 6 heats up and generates a maintenance current Im which circulates through the magnetic means 10, 11 and 12 of the corresponding electromagnetic valve 2. When said thermocouple 6 reaches a sufficient temperature, the maintenance current Im is such that the magnetic means 10, 11 and 12 of the electromagnetic valve 2 keep the gas flow to the corresponding gas burner 1 open.

The inventive control system 20 can be applied not only to cooking devices such as gas hobs, gas ovens, etc, but also to other types of gas devices such as gas heaters, boilers or stoves.

The invention claimed is:

1. Control system for a gas cooking device or any other gas device comprising at least one gas burner and, for each gas burner an electromagnetic valve to open or cut off the gas flow to the gas burner, said electromagnetic valve comprising magnetic means to keep the gas flow open, and an actuator that is operated manually so that it can act on the magnetic means of the electromagnetic valve, thereby opening the gas flow, wherein the control system detects when the actuator is operated, said control system generating a current signal that circulates through the magnetic means so that, when said actuator is operated, a change in magnetic reluctance of the magnetic means occurs, the control system detecting the operating of the actuator in accordance with said change in magnetic reluctance.

2. Control system according to claim 1, wherein the change in magnetic reluctance is detected by checking the voltage in the terminals of the magnetic means.

3. Control system according to claim 2, wherein the current signal is generated from a pulse signal and the voltage in terminals of the magnetic means is checked during the pulses of said pulse signal.

4. Control system according to claim 3, wherein the voltage in the terminals of the magnetic means is checked in a sampling instant from the beginning of each pulse, so that the control system determines that the actuator has been operated because, due to the change in magnetic reluctance caused by said operating, the checked voltage moves, between consecutive pulses, from a smaller value than a reference voltage to a larger value than said reference voltage.

5. Control system according to claim 4, wherein said sampling instant is in the interval between a first instant and a second instant, said first instant being the instant from the beginning of each pulse in which, with the actuator not operated, the voltage in the terminals of the magnetic means reaches the reference voltage, and said second instant being the instant from the beginning of each pulse in which, when the actuator is operated, the voltage in the terminals of the magnetic means reaches the reference voltage.

6. Control system according to claim 3, wherein the pulse signal has a frequency between 20 Hz and 1 kHz.

7. Control system according to claim 6, wherein the pulse signal has a frequency of 50 Hz.

8. Control system according to claim 1, wherein a spark generator is acted on when a change in magnetic reluctance of the magnetic means is detected, with said spark generator generating a series of sparks to light a flame in the burner.

9. Control system according to claim 1, wherein assistance means are acted on when the change in magnetic reluctance of the magnetic means is detected, causing said assistance means to circulate a maintenance current through said magnetic means to keep the gas flow open.

* * * * *